United States Patent [19]

Galloway et al.

[11] Patent Number: 4,616,112

[45] Date of Patent: Oct. 7, 1986

[54] ELECTRICAL SWITCH HAVING ARC-PROTECTED CONTACTS

[75] Inventors: Michael D. Galloway, Middletown; William H. Rose; David T. Shaffer, both of Harrisburg, all of Pa.

[73] Assignee: AMP Incorporated, Harrisburg, Pa.

[21] Appl. No.: 784,695

[22] Filed: Oct. 3, 1985

Related U.S. Application Data

[63] Continuation of Ser. No. 644,736, Aug. 27, 1984, abandoned.

[51] Int. Cl.[4] ..... H01H 9/30; H01H 13/50; H01H 15/02

[52] U.S. Cl. ..... 200/5 R; 200/16 D; 200/144 R; 200/159 A; 200/238

[58] Field of Search ..... 200/1 R, 5 R, 5 A, 11 A, 200/11 DA, 11 G, 11 J, 11 K, 11 TW, 16 B, 16 C, 16 D, 16 E, 144 R, 159 R, 159 A, 164 R, 164 A, 237–243, 252, 253, 292, 314

[56] References Cited

U.S. PATENT DOCUMENTS

| | | | |
|---|---|---|---|
| 3,293,399 | 12/1966 | Heinrich | 200/292 |
| 3,378,654 | 4/1968 | Hoy et al. | 200/16 C |
| 3,818,169 | 6/1974 | Kobernus | 200/159 A |
| 4,161,637 | 7/1979 | Priesemuth | 200/159 R X |
| 4,168,405 | 9/1979 | Raab et al. | 200/144 R X |
| 4,225,758 | 9/1980 | Kondo et al. | 200/159 A X |
| 4,371,759 | 2/1983 | Clark, Jr. | 200/5 R |
| 4,497,983 | 2/1985 | Galloway et al. | 200/5 R |

FOREIGN PATENT DOCUMENTS

| | | | |
|---|---|---|---|
| 2439421 | 2/1976 | Fed. Rep. of Germany | 200/159 A |

*Primary Examiner*—J. R. Scott

*Attorney, Agent, or Firm*—Adrian J. LaRue; Anton P. Ness

[57] ABSTRACT

An electrical switch comprises a dielectric base member having parallel stationary contact assemblies provided with aligned contact segments, each of the contact segments including an exposed contact section and a dielectric section. A spring-biased movable contact assembly is disposed between the stationary contact assemblies and includes cantilevered arcuate contact sections springably engaging respective aligned contact segments. The exposed contact sections have parallel projections and the dielectric sections have a projection along which the arcuate contact sections move, one of the parallel projections being longer so that, when the arcuate contact sections move from the contact sections onto the dielectric sections or vice versa, the arcuate contact sections engage the longer projection last or first so that an electric arc, if it occurs, will occur therebetween rather than between the short projections and the arcuate contact sections.

23 Claims, 11 Drawing Figures

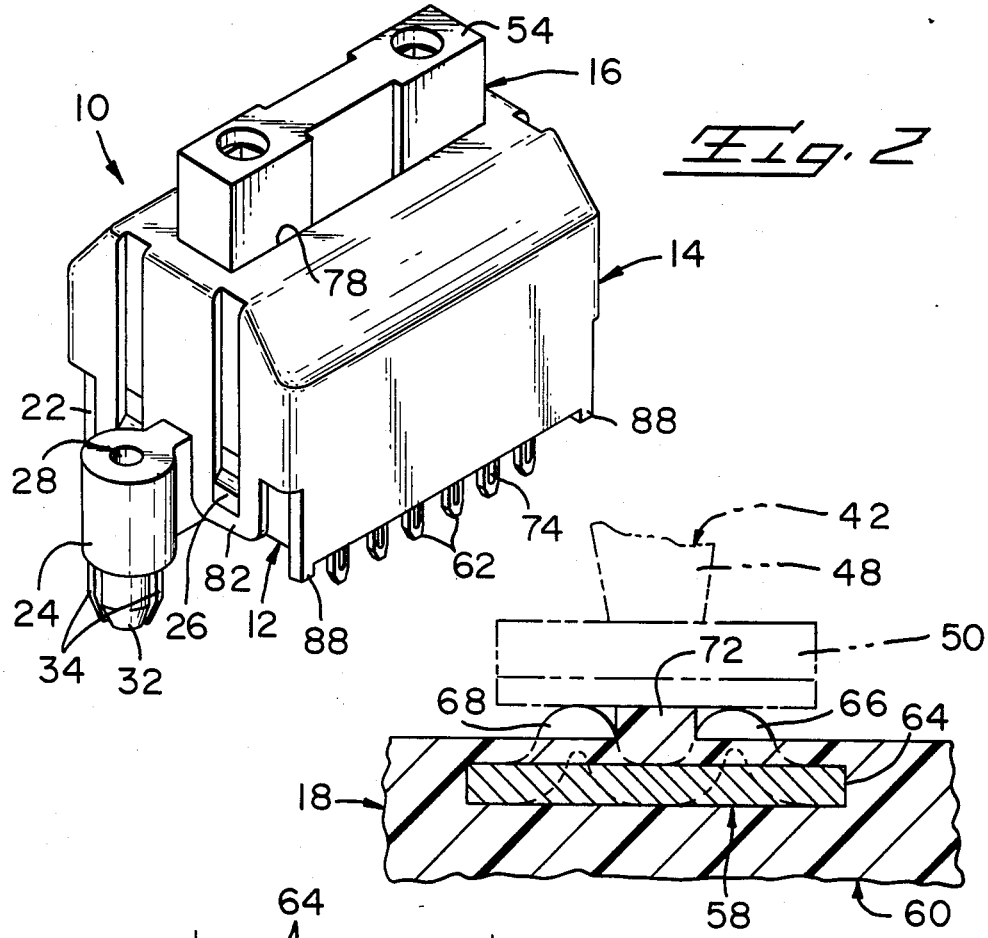
Fig. 2
Fig. 9
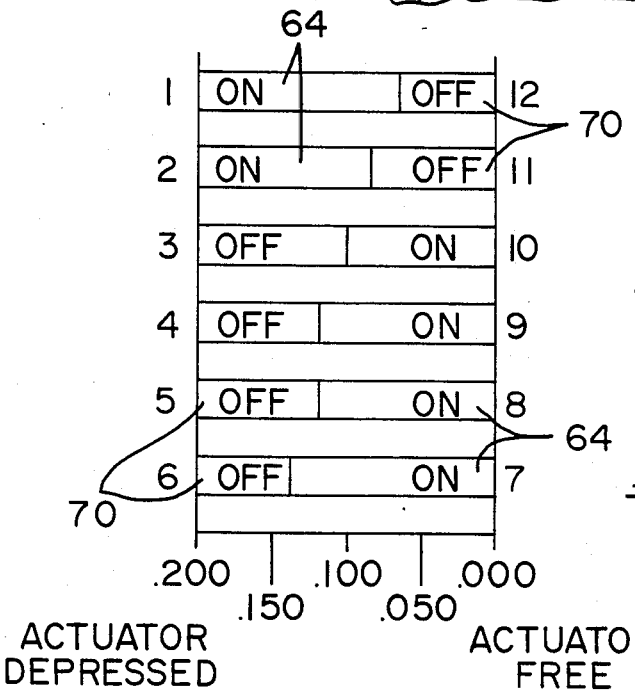
TIME LAG DIAGRAM
Fig. 10

ELECTRICAL SWITCH HAVING ARC-PROTECTED CONTACTS

This application is a continuation of application Ser. No. 644,736 filed Aug. 27, 1984, now abandoned.

FIELD OF THE INVENTION

The present invention relates to electrical switches and more particularly to electrical switches wherein the electrical contacts include contact sections that are protected from arcing.

BACKGROUND OF THE INVENTION

Electrical arcs occur between the stationary and movable electrical contact members in a switch of the type disclosed in U.S. Pat. No. 4,497,983 when a high inductance load is part of the electrical circuit in which the switch is electrically connected. The electrical arcs dissipate the contact areas of the positions at which the movable and stationary contact members engage one another. The dielectric material of the dielectric sections of the planar contact segments also melts at the junctions with the metal contact sections due to the occurrence of the electric arcs resulting in disruption of the smooth travel along the dielectric sections and metal contact sections during the relative movement between the stationary and movable contact members. The melted dielectric material also wipes onto some of the metal contact sections during the relative movement between the stationary and movable contact members which not only disrupts the smooth operation along the planar contact segments but also disrupts the timing sequence of operation of the switch. This situation could also cause open contacts. Additionally, the arcing across the movable and stationary contact members increases the resistance.

As a result of these adverse effects caused by the arcing between the electrical contacts when switching a high inductance load, the operating life of the switch of U.S. Pat. No. 4,497,983 is substantially reduced. The switch of the present invention has overcome these drawbacks and includes contact sections of the contact members that are protected from arcing thereby providing a switch having a substantially increased operating life. Moreover, the contact segments comprising metal contact sections and dielectric sections form stationary contact assemblies in the present invention rather than being the movable contact assembly of the switch of U.S. Pat. No. 4,497,983.

SUMMARY OF THE PRESENT INVENTION

According to the present invention, a switch comprises a dielectric base member having stationary electrical contact assemblies disposed therealong; the contact segments in one row are aligned with respect to the contact segments in the other row and each contact segment includes a metal contact section of a specified length and the remaining length is a dielectric section. The metal contact section is in the form of parallel projections with one projection being longer than the other at the junction between the metal contact section and the dielectric section. The dielectric section has a projection therealong disposed between the parallel projections of the metal contact section. A dielectric cover member is latchably secured onto the base member. A movable contact assembly mounted in the cover member includes an operating member and a contact-carrying member. The operating member is linearly movable within an opening in the cover member from a normally inoperative position to an operative position against a spring member extending between the operating member and the base member. The contact-carrying member has movable electrical contact members isolated from one another; each of the movable contact members includes arcuate electrical contact sections at free ends of cantilever sections so that the arcuate electrical contact sections of each movable contact member springably engage respective contact segments to electrically connect the metal contact sections together when engaging the metal contact sections or to electrically disconnect the metal contact sections when the arcuate contact sections engage the dielectric sections in either of the operative or inoperative positions.

BRIEF DESCRIPTION OF THE DRAWINGS

FIG. 2 is a perspective view of the switch of the present invention in an assembled condition.

FIG. 9 is a cross-sectional view taken along line 9—9 of FIG. 6 showing the relative heights of the parallel projections of the electrical contact sections and the projection of the dielectric material as being coplanar and the movable arcuate contact section disposed on the plane containing the surfaces of the projections therein.

FIG. 10 is a typical operating diagram of the contact members of the switch over a specified distance.

DETAILED DESCRIPTION OF THE INVENTION

Figure 1:
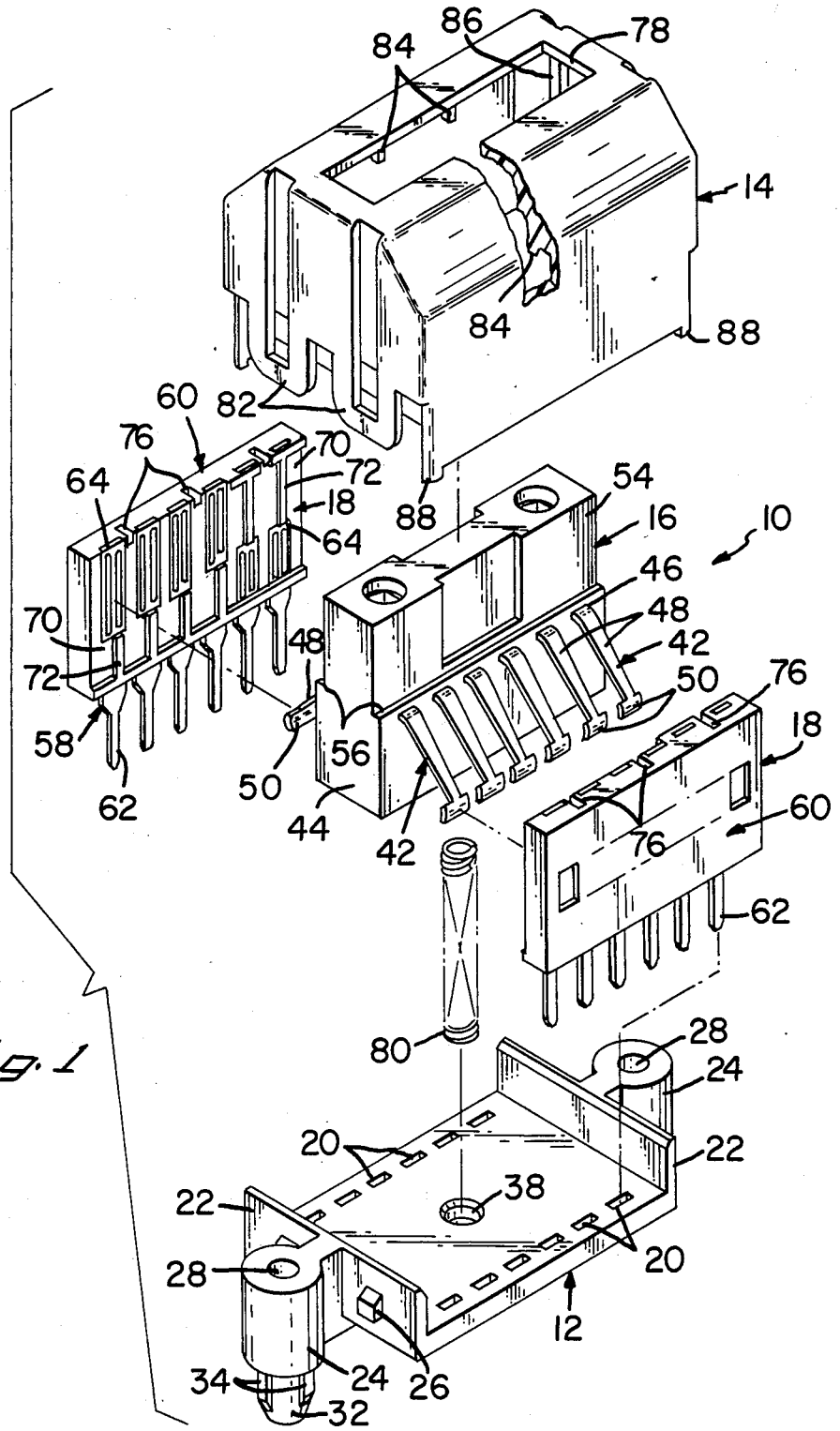
FIG. 1 is an exploded perspective view of parts of the switch of the present invention.

As shown in FIGS. 1 through 5 of the present invention, an electrical switch 10 comprises a dielectric base member 12, a dielectric cover member 14, a movable contact assembly 16, and stationary contact assemblies 18. Members 12, 14 and the dielectric parts of assemblies 16 and 18 are molded from a suitable dielectric material such as, for example, glass-filled polyester material.

Dielectric base member 12 has a series of rectangular apertures 20 along respective sides and endwalls 22 from which depend mounting members 24 and latching projections 26. Holes 28 extend through mounting members 24 as illustrated in FIGS. 1 and 2 to mount switch 10 in position on a circuit board 30 via bolts, if desired. Alternatively, members 24 can include press-fit members 32 which have spaced projections 34 therearound enabling members 32 to be press-fit into respective holes in board 30 thereby maintaining switch 10 shown thereon during the flow soldering of the terminal sections of the stationary contact members to respective conductive paths 36. Base member 12 has an annular recess 38 centrally thereof between walls 22 and a central projection 40 engages board 30 to space base member 12 from board 30 when secured thereto.

Figure 3:
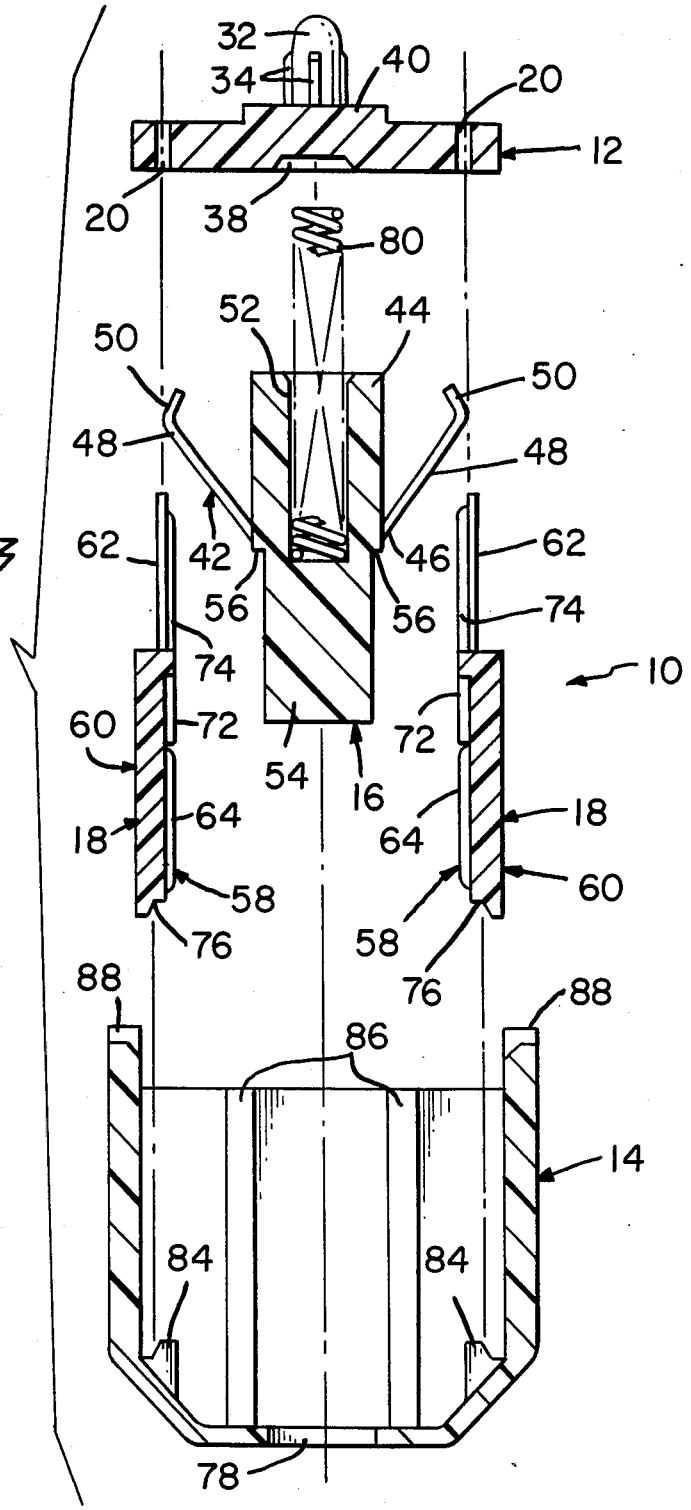
FIG. 3 is an exploded longitudinal section view of the parts of the switch of FIG. 1 showing the parts in their positions of assembly.

A series of movable electrical contact members 42 are molded into contact-carrying section 44 of movable contact assembly 16. Each of movable electrical contact members 42 includes a securing section 46 secured in contact-carrying section 44, cantilever sections 48 extending outwardly from each side of and at an angle with respect to contact-carrying section 44, and an arcuate contact section 50 at the free end of each cantilever section 48. A blind hole 52 is located centrally of contact-carrying section 44, as seen in FIG. 3. An actuating section 54 is integral with contact-carrying section 44 and stop surfaces 56 are located at the junction therebetween.

Movable contact members 42 are stamped in strip form in accordance with conventional metal stamping and forming practices from a suitable metal having the required spring characteristics such as, for example, phosphor bronze. The strip of movable contact members 42 is fed into a mold to mold sections 44, 54 thereto with the requisite number of movable contact members 42 thereby forming a strip of movable contact assemblies 16. The contact members 42 of the movable contact assemblies are subjected to a forming operation using conventional forming dies which bend cantilever sections 48 to the required angular orientation, whereafter the movable contact assemblies 16 can be fed via the strip to the assembly position for positioning in cover members 14 as shown in FIG. 3, the movable contact assemblies being removed from the strip by cutting the contact member 42 thereof from the strip prior to being positioned in the cover member.

Figure 6:
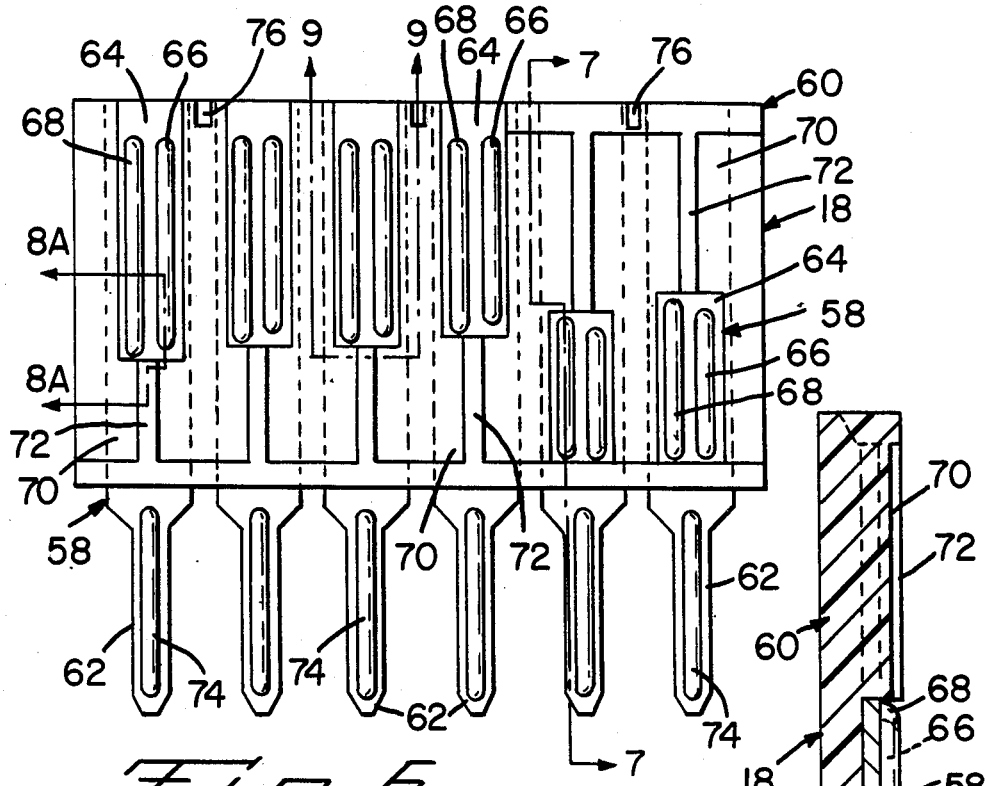
FIG. 6 is a front elevational view of one of the stationary contact assemblies showing the contact segments thereof.
Figure 7:
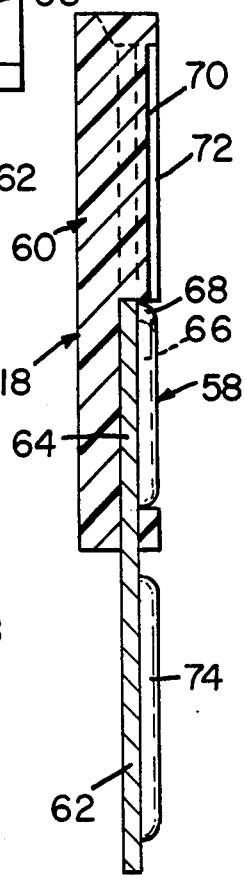
FIG. 7 is a longitudinal section view taken along line 7—7 of FIG. 6.

Stationary contact assemblies 18 include electrical contact members 58 molded in position in dielectric frame member 60. Each contact member 58 includes a terminal section 62 and a contact section 64 exposed in frame member 60. As best shown in FIGS. 6, and 7 each exposed contact section 64 is disposed on the surface of stationary contact assembly 18, has a specific length and includes axially extending parallel projections 66, 68, projections 68 being longer than projections 66 at the junctions of exposed contact sections 64 with dielectric sections 70, disposed on and comprising part of a surface portion of stationary contact assembly 18. Each of dielectric sections 70 includes a projection 72 centrally disposed between projections 66, 68. Thus, exposed contact sections 64 and their associated respective dielectric sections 70 form a series of contact segments having exposed contact sections preferably of varying lengths and the contact surfaces of projections 66, 68 and the upper surfaces of respective projections 72 are coplanar thereby providing substantially planar surfaces along which arcuate contact sections 50 can move. Terminal sections 62 preferably have projections 74 formed therein to strengthen them. Recesses 76 are located in the upper inner edges of frame member 60.

Contact members 58 are stamped and formed in accordance with conventional metal stamping and forming practices from a suitable metal such as brass in strip form with contact sections 64 being formed in accordance with the manner in which they are to be exposed in dielectric frame member 60. The strip of contact members 58 is fed to a conventional mold in which dielectric frame members 60 are molded to the requisite number of contact members 58 thereby forming a strip of stationary contact assemblies 18 which are then fed to the assembly position for positioning into cover members 14 as shown in FIG. 3, the stationary contact assemblies 18 being cut from their strips by cutting contact members 58 along and coincident with the top surfaces of frame members 60 prior to being inserted into cover members 14.

Cover member 14 is provided with an opening 78 through its upper wall so that operating section 54 of movable contact assembly 16 normally extends therethrough under the bias of coil spring 80 which is disposed in hole 52 in section 44 and in recess 38 of base member 12 when base member 12 is latched to cover member 14. Integral U-shaped flexible latching members 82 on cover member 14 latchably engage latching projections 26 on base member 12 with terminal sections 62 extending through respective apertures 20 in base member 12 thereby latchably securing cover member 14 and base member 12 together. Stationary contact assemblies 18 are positioned along the inner surfaces of respective side walls of cover member 14 and movable contact assembly 16 is in a normally inoperative position under the influence of spring 80 with stop surfaces 56 engaging the inner surface of the upper wall of cover member 14 and arcuate contact sections 50 engaging respective projections 66, 68 of contact sections 58 or projections 72 of dielectric sections 70 as shown in FIG. 4.

Projections 84 extend outwardly from the inside surface of the upper wall of cover member 14 and are disposed in respective recesses 76 in frame members 60 of stationary contact assemblies 18 thereby maintaining the contact assemblies adjacent the respective side walls of cover member 14 in conjunction with terminal sections 62 in apertures 20 of base member 12.

Figure 5:
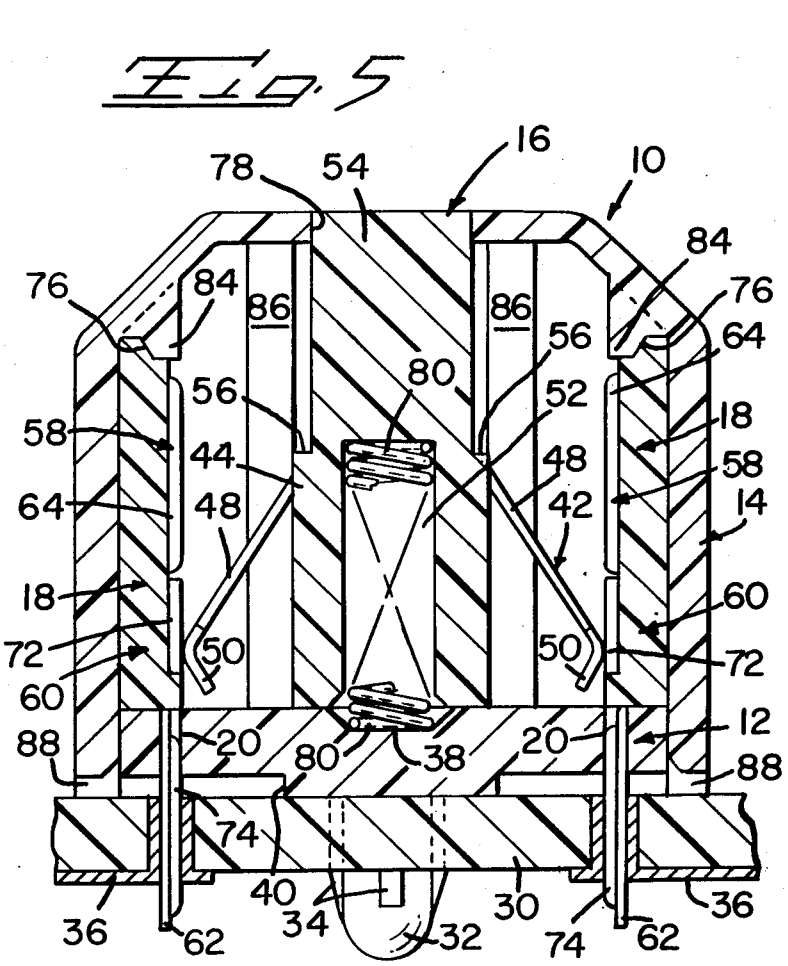
FIGS. 4 and 5 are longitudinal section views of FIG. 1 showing the switch in inoperative and operative positions.
Figure 4:
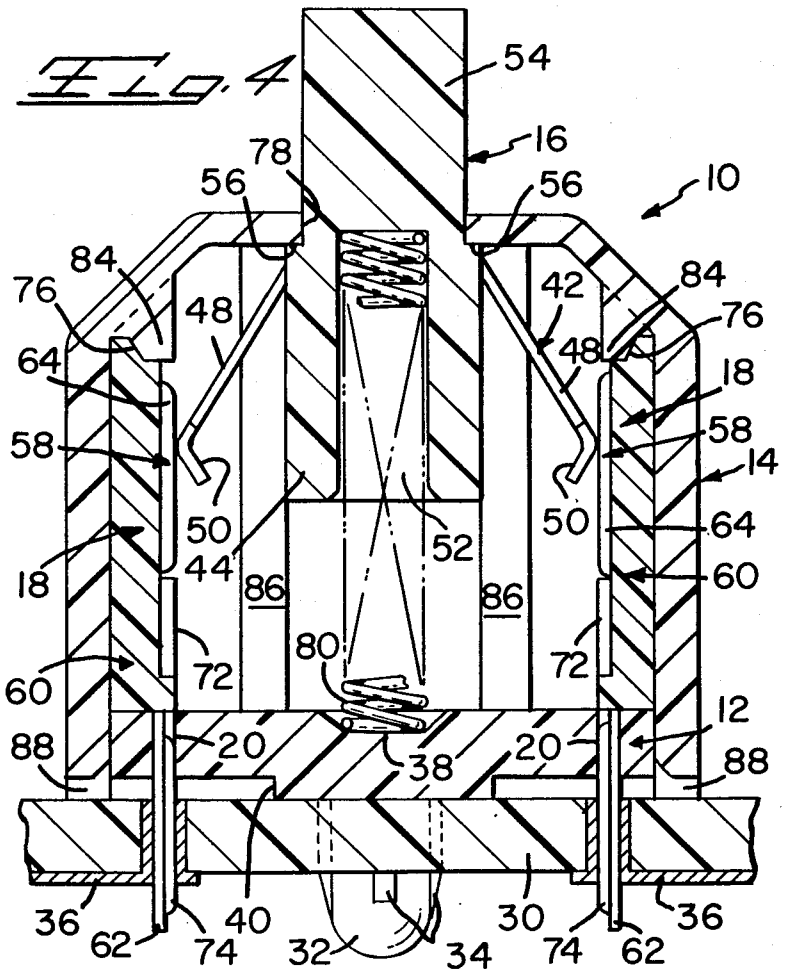

Spaced and parallel projections 86 extend along inside surfaces of the end walls of cover member 14 as shown in FIGS. 3 through 5 so that the ends of contact-carrying section 44 of movable contact assembly 16 are disposed therebetween to stabilize and guide movable contact assembly 16 as it is moved axially towards base member 12 from inoperative to operative positions as shown in FIGS. 4 and 5.

Legs 88 are located at the corners of cover member 14 for engagement with board 30 just as projection 40 of base member 12 engages board 30 thereby spacing switch 10 from board 30 to enable flux or other foreign matter to be removed.

In assembly as shown in FIG. 3, a cover member 14 in an inverted position at an assembly position has stationary contact assemblies 18 inserted along respective sides of cover member 14 so that projections 84 engage respective recesses 76. A movable contact assembly 16 having coil spring 80 in hole 52 is moved along stationary contact assemblies 18 with arcuate contact sections 50 springably engaging projections 66, 68 of exposed contact sections 58 or projections 72 of dielectric sections 70 of the respective contact segments of the stationary contact assemblies 18, operating section 54 extending through opening 78 and stop surfaces 56 engaging the inside surface of the upper wall of cover member 14. Base member 12 is then latchably secured to cover member 14 via latching member 82 and latching projections 26 with terminal sections 62 extending through respective apertures 20 in base member 12. The assembled switch 10 is now ready to be tested.

Figure 8A:
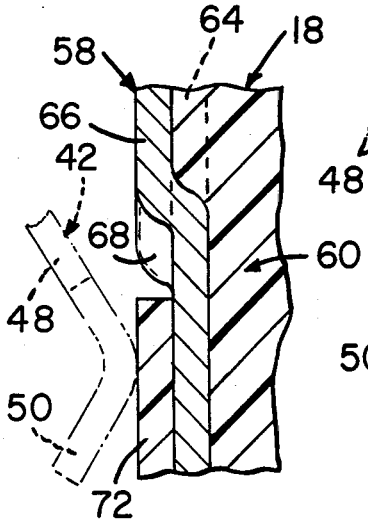
FIGS. 8A and 8B are part longitudinal section views taken along line 8A—8A of FIG. 6 showing the movement of the movable arcuate contact section shown in phantom along the stationary contact segment.
Figure 8B:
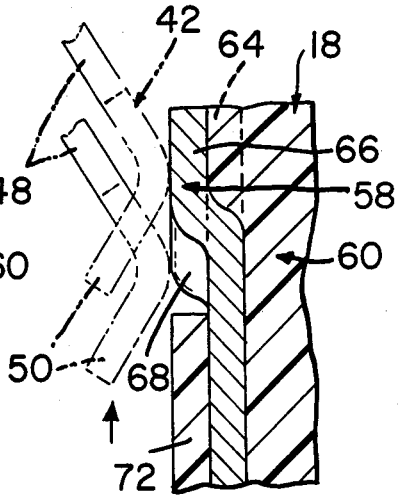

In operation, as illustrated in FIGS. 4 and 5, when an operating force is applied to operating section 54, movable contact assembly 16 is moved inwardly against the bias of spring 80. Arcuate contact sections 50 of movable contact members 42 engage respective contact segments of stationary contact assemblies 18 and move therealong as movable contact assembly 16 is moving. As arcuate contact sections 50 move from exposed contact sections 64 to dielectric sections 70, seen in FIGS. 6, 8A and 8B, arcuate contact sections 50 move along the long projections 68 of contact sections 64 during the last part of the movement along contact sections 64 thereby being free of shorter projections 66. As arcuate contact sections 50 move from projections 68 onto projection 72, an electric arc is generated between contact sections 50 and projections 68 if a high inductance load is connected to switch 10. Thus, no electric arc occurs between contact sections 50 and short projections 66 leaving projections 66 free of any arc damage.

When arcuate contact sections 50 move from projections 72 of dielectric sections 70 onto projections 66, 68 of contact sections 64, contact sections 50 first move onto long projections 68 so that if an electric arc occurs, it occurs between projections 68 and contact sections 50 and not between contact sections 50 and projections 66. In this way, projections 66 are always clean and undamaged resulting in a low resistance path for carrying the electric current between arcuate contact sections 50 and projections 66 of contact sections 64. Such an arrangement will substantially extend the operating life of switch 10. Section 44 of movable contact assembly 16 bottoms on base member 12 limiting movement of movable contact assembly 16 within cover member 14 which maintains arcuate contact sections 50 on the contact segments.

The movement of arcuate contact sections 50 along projections 66, 68 and 72 is smooth because of the arcuate configuration of contact sections 50 and the contact surfaces of projections 66, 68 and the top surface of projections 72 being in the same plane, shown best in FIGS. 8 and 9.

Alternatively, contact members 58 can be molded in the sides of contact-carrying section 44 of movable contact assembly 16 forming contact segments of exposed contact sections 64 and dielectric sections 70, and cantilever sections 48 of contact members 42 including arcuate contact sections 50 can be molded in base member 12 with terminal sections 62 as part of contact members 42 extending outwardly from a bottom surface of base member 12 so that the contact segments are movable relative to the cantilevered arcuate contact sections 50.

The contact surfaces of contact sections 64 are preferably silver-plated over nickel plating and the contact surfaces of arcuate contact sections 50 are preferably palladium-plated over nickel plating to reduce the frictional movement between contact sections 50, 64 and the arcing therebetween.

FIG. 10 is an operating diagram for switch 10 wherein the right side of the diagram illustrates one row of stationary electrical contact segments and the left side illustrates the other row of stationary electrical contact segments which have their respective contact segments arranged as opposite pairs in engagement with respective arcuate contact sections 50 of movable contact members 42. As can be discerned, the movement of the movable contact assembly is from right to left which indicates the off-on or on-off conditions of each of the pairs of contact sections 64 as arcuate contact sections 50 move with respect to contact sections 64 when the movable contact assembly is moved upon actuation of actuating section 54 against the bias of coil spring 80. The reverse operation takes place when it is moved to its normally inoperative position. Thus, when actuating section 54 is in its normally inoperative position, four of the pairs of contact sections 64 will be in an actuated position due to the fact that they will be in electrical engagement with each other via arcuate contact sections 50, whereas two of the pairs of contact sections 64 will be in a non-actuated position and will not be connected because arcuate contact sections 50 will be in engagement with dielectric sections 70 as shown in FIG. 10. The reverse situation takes place, as shown in FIG. 6, when an actuating force is applied to actuating section 54 causing the movable contact assembly to move to its actuated position which results in four of the pairs of contact sections 64 being in a non-actuated position while the remaining two pairs of contact sections 64 are in an actuated position.

If desired, sealing material such as an epoxy material or other suitable sealing material can be disposed in apertures 20 to form a seal along the terminal sections 62.

The switch is of simplified construction that is easily assembled, has a long operating life, and can easily be connected to a circuit board. The length of exposed contact sections 64 can be varied to vary the sequence of operation and can operate in a high inductance circuit.

We claim:

1. An electrical switch, comprising:

dielectric cover means;

movable contact assembly means disposed in said cover means movable along an axis therewithin and capable of spring-biased actuation by actuating means and having opposing side surfaces;

first electrical contact members secured to said movable contact assembly means by mounting sections and each having a pair of first contact section means, each of said pair being disposed along a respective said opposing side surface;

two stationary contact assembly means disposed in said cover means each proximate and spaced from a respective opposing side surface of said movable contact assembly means;

second electrical contact members secured to each said stationary contact assembly means arranged in opposing pairs and having second contact section means proximate said opposing side surfaces of said movable contact means, said second electrical contact members also having terminal sections capable of electrical connection to respective conductive elements of an electrical article;

ones of said first and said second electrical contact members having their contact section means disposed on respective surface portions of one of said movable and said two stationary contact assembly means, and being axially aligned with respective dielectric section means of said respective surface portions and joined thereto at respective junctions forming separate contact segment means;

the others of said first and said second electrical contact members having their contact section means disposed along and extending outwardly from respective surface portions of the other of said movable and said two stationary contact assembly means, associated with and springably engaging respective said contact segment means, and capable of relative axial movement along said respective said contact segment means when said movable contact assembly means is actuated by said actuating means whereby each said opposing pair of second contact members will be electrically connected by a respective said first contact member when said first contact section means thereof are in electrical engagement with respective said second contact section means, and will be electrically disconnected when said first contact section means are in engagement with respective said dielectric section means; and ends of said ones of said first and said second contact section means proximate respective said junctions have means at which an electric arc will occur rather than over the entire said ends thereby extending the operating life of said ones of said contact section means.

2. An electrical switch as set forth in claim 1, wherein each of said ones of said contact section means includes two axially extending parallel projections as part of the contact section means with one of the parallel projections extending closer to the respective junction with the dielectric section means of the contact segment than the other of the parallel projections, whereby when an associated said other of said contact section means is disposed on said contact segment proximate said junction, an electric arc can occur between said other of said contact section means and said one projection whereby said other projection remains undamaged.

3. An electrical switch as set forth in claim 2, wherein said dielectric section means has a projection centrally disposed with respect to the parallel projections of the respective said associated contact section means and extending to said junction.

4. An electrical switch as set forth in claim 3, wherein the contact surfaces of the parallel projections and the top surface of the dielectric projection are coplanar, whereby the movement of said associated other contact section means between said parallel projections and said dielectric projections is smooth.

5. An electrical switch assembly, comprising:

a dielectric cover member;

a dielectric base member secured to said cover member;

a movable contact assembly disposed in said cover means movable along an axis therewithin towards and away from said base member and having opposing side surfaces;

actuating means capable of moving said movable contact assembly along said axis between an actuated and a nonactuated position;

a plurality of electrical contact members secured to said movable contact assembly each having a mounting section and a pair of cantilevered contact sections each said contact section extending outwardly from a respective said side surface of said movable contact assembly;

first and second stationary contact assemblies secured within said cover member adjacent said base member and disposed along said opposing side surfaces of said movable contact assembly, each said stationary contact assembly having a like plurality of axially aligned stationary contact members extending normally to said base member, said stationary contact members of said first and second stationary contact assemblies being arranged in opposing pairs, each said contact member having a terminal section capable of electrical connection to a respective conductive element of an electrical article and also having a contact section disposed on a surface of a respective said stationary contact assembly axially aligned with and joined at a junction to a dielectric section of said surface to form a contact segment; and said cantilevered contact sections of a said electrical contact member of said movable contact assembly springably engaging respective contact segments of a said pair of opposing stationary contact members, said movable contact assembly being normally positioned in an inoperative position and being movable by said actuating means to an operative position when an operating force is applied thereto so that, depending on the position of said movable contact assembly when the cantilevered contact sections engage the contact sections of the pair of respective contact segments, the pair of stationary contact members will be electrically connected, and when the cantilevered contact sections engage the dielectric sections of the respective contact segments, the pair of stationary contact members will be disconnected.

6. An electrical switch assembly as set forth in claim 5, wherein the cantilevered contact sections have arcuate end portions engageable with said contact segments.

7. An electrical switch as set forth in claim 5, wherein the lengths of the contact sections and the dielectric sections of the contact segments can vary to vary the sequence of electrical connection and disconnection of the contact sections.

8. An electrical switch assembly as set forth in claim 5, wherein selected said contact segments have respective dielectric sections and contact sections in relatively reversed locations from the locations of the dielectric sections and contact sections of other contact segments, whereby said contact sections of said selected contact segments will be electrically disconnected by respective said cantilevered contact sections when the contact sections of said other contact segments will be electrically connected, when said movable contact assembly is in a selected position, and will be electrically connected when the contact sections of said other contact segments will be electrically disconnected, when said movable contact assembly is in the other position.

9. An electrical switch assembly as set forth in claim 5, wherein said stationary contact members are integrally molded within a respective stationary contact assembly such that said dielectric sections are integral with said stationary contact assembly.

10. An electrical switch assembly as set forth in claim 5, wherein each of the contact sections of said stationary contact members has two axially extending parallel projections both engageable by a respective said cantilevered contact section.

11. An electrical switch assembly as set forth in claim 10, wherein one of the parallel projections of a said contact section extends closer to the respective junction than the other projection, whereby when a said cantilevered contact section is disposed on the contact segment proximate said junction, an electric arc can occur between said cantilevered contact section and said one projection whereby said other projection remains undamaged.

12. An electrical switch assembly as set forth in claim 11, wherein the dielectric section of a said contact segment has an axial projection centrally disposed with respect to said parallel projections of said contact section and extending to said junction.

13. An electrical switch assembly as set forth in claim 12 wherein the contact surfaces of said parallel projections of said contact section and the top surface of said dielectric projection are coplanar, whereby the movement of a said cantilevered contact section between said parallel projections and said dielectric projection is smooth.

14. An electrical switch assembly as set forth in claim 5, wherein said actuating means comprises an operating section of said movable contact assembly extending outwardly through an opening in said cover member, and a compression spring axially disposed and secured between said movable contact assembly and said base member.

15. An electrical switch assembly as set forth in claim 14 wherein said movable contact assembly includes stop means engageable with said cover member which maintains said movable contact assembly in the normal inoperative position.

16. An electrical switch assembly as set forth in claim 14, wherein the cover member includes guide means along inside surfaces of end walls thereof so that end sections of said movable contact assembly are respectively disposed therein to stabilize and guide the movement of said movable contact assembly.

17. An electrical switch assembly as set forth in claim 14 wherein said base member and said cover member have latching means latchably securing them together.

18. An electrical switch assembly as set forth in claim 5 wherein said terminal sections of said stationary contact members extend through apertures in said base member for electrical connection with conductive paths of a printed circuit board.

19. An electrical switch as set forth in claim 18, wherein said base member includes press-fit means for being press fit into holes in the printed circuit board.

20. A contact arrangement for an electrical switch of the type having a movable contact assembly axially movable from a nonoperative position to an operative position between two rows of stationary contacts where contacts of said movable contact assembly each springably engage and electrically connect an opposing pair of said stationary contacts when moved to the operative position engaging contact sections of said stationary contacts, and engage dielectric sections adjoining said contact sections when moved to the inoperative position and electrically disconnect said opposing pair of stationary contacts, said contact arrangement comprising:

each said stationary contact is secured to a dielectric member such that said contact section thereof is disposed on a surface thereof and axially aligned with and having an end joined at a junction to a said dielectric section; and said end of said contact section includes means at which an electric arc will occur between said stationary contact member and a respective said movable contact positioned at said junction rather than over the entire said end thereby extending the operating life of said stationary contact.

21. A contact arrangement as set forth in claim 20, wherein said contact section includes two axially extending parallel projections both engageable by a respective said movable contact, and one of said projections extends closer to said junction than the other projection, whereby when a said movable contact is disposed proximate said junction, an electric arc can occur between said movable contact and said one projection whereby said other projection remains undamaged.

22. A contact arrangement having a first contact and a second contact wherein said second contact is relatively movable to and from a first position in electrical engagement with said first contact from and to a second position not in electrical engagement therewith, characterized in that:

one of said first and said second contacts includes an end thereof relatively closest to the other of said contacts when said second contact is in said second position; and said end of said one of said contacts includes means at which an electric arc will occur between said first contact and said second contact rather than over the entire said end thereby extending the operating life of said one of said contacts.

23. A contact arrangement as set forth in claim 22, wherein said one of said contacts includes two axially extending parallel projections both engageable by said other of said contacts, and one of said projections extends closer to said other of said contacts when said second contact is in said second position than the other of said projections, whereby when said second contact is disposed proximate said first contact, an electric arc can occur between said other of said contacts and said one projection whereby said other projection remains undamaged.

* * * * *